US007268281B2

(12) United States Patent
Armato

(10) Patent No.: US 7,268,281 B2
(45) Date of Patent: Sep. 11, 2007

(54) APPARATUS FOR ABRADING A REED USED IN A MUSICAL INSTRUMENT

(76) Inventor: Ben N. Armato, 17 Sherbrooke Rd., Hartsdale, NY (US) 10530

( * ) Notice: Subject to any disclaimer, the term of this patent is extended or adjusted under 35 U.S.C. 154(b) by 209 days.

(21) Appl. No.: 11/104,739

(22) Filed: Apr. 13, 2005

(65) Prior Publication Data

US 2006/0230906 A1 Oct. 19, 2006

(51) Int. Cl.
*G10D 9/02* (2006.01)

(52) U.S. Cl. ..... 84/383 A; 451/558

(58) Field of Classification Search ..... 84/383 A, 84/383 R, 380 R; 451/558; D17/13; 139/192
See application file for complete search history.

(56) References Cited

U.S. PATENT DOCUMENTS 4,231,404 A * 11/1980 Van Doren et al. ..... 144/2.1
4,669,515 A * 6/1987 Trent ..... 144/115
4,809,583 A * 3/1989 Kume ..... 84/453
5,241,793 A * 9/1993 Armato ..... 451/558

* cited by examiner

*Primary Examiner*—Lincoln Donovan
*Assistant Examiner*—Jianchun Qin
(74) *Attorney, Agent, or Firm*—Fish & Richardson P.C.

(57) ABSTRACT

An apparatus for abrading a reed for a musical instrument comprises: a base having two top surfaces tilted toward each other and having tapered parallel tracks in its side edge surfaces; and a carriage slidable on the tracks. The carriage includes an abrasive surface adopted to contact a reed placed on one of the top surfaces of the base.

10 Claims, 3 Drawing Sheets

APPARATUS FOR ABRADING A REED USED IN A MUSICAL INSTRUMENT

FIELD OF THE INVENTION

This invention relates to apparatus for abrading a reed for a musical instrument and, more particularly, to an improved apparatus for honing a reed for a clarinet or other single-reed musical instrument.

BACKGROUND OF THE INVENTION

Reeds used in single-reed instruments, such as clarinets, are usually manufactured from cane obtained from the *Arundo donax* plant. There is considerable variance in the sound quality, longevity and general "playability" among individual reeds. The internal physical structure of each reed is unique and marked by a myriad variations in size, vascular bundles, etc. Even within a package of reeds from a single manufacturer, a musician will typically find that no more than one or two reeds in a package of ten will possess satisfactory playing characteristics. Furthermore, all commercially manufactured reeds need to be redesigned by abrasion in order to improve tone quality and ease of playing.

The vamp portion of reeds designed for all single reed instruments has a parabolic shape. A device for abrading such reeds must be capable of the corrective parabolic design in order for the reed to perform at its maximum level of effectiveness.

Kume U.S. Pat. No. 4,809,583 relates to a device for honing a reed for a musical instrument, the device having a reed guide base and an adjusting spatula with a curved end portion and a file bonded thereto for adjusting the thickness of the reed. The effectiveness of a device of this type depends almost exclusively on the manual dexterity of the operator who must carefully hold and operate the spatula in a totally manual operation. Furthermore, a device of this type does not permit variation in transverse abrasion.

Armato U.S. Pat. No. 5,241,793 represents a considerable improvement in the reed abrasion process in that it makes it possible for commercially manufactured reeds to be abraded and shaped according to the individual needs of the player. The device there disclosed comprises a base having two longitudinally tapered ramps (tracks), and upper portion (carriage) slidable on the tapered ramps and bearing a substantially flat abrasive portion adjacent and spaced from the top surface of the base. The top surface contains guidelines for the placement of the reed to be abraded and, by appropriate placement of the reed on the top surface, abrasion can be accomplished to the individual desires of the musician. Although the device disclosed in U.S. Pat. No. 5,241,793 was a great improvement in the art of abrading reeds, further improvements are desirable in order to provide for greater precision in redesigning the shape of the reed's parabolic design, thus allowing the reed to perform at its maximum.

SUMMARY OF THE INVENTION

In accordance with this invention, an improved apparatus for abrading a reed has been provided. The apparatus comprises a base having two longitudinally tapered tracks and carriage slidable on said tracks. In order to provide for more precise movement of the carriage, channels are provided in the vicinity of the tracks which guide and control the movement of the carriage. Additionally, the top surface of the base are provided with stopper pins and a longitudinally disposed central beam, which together function as improved guides for placement of the carriage and the reed to be abraded. The top surfaces are also provided with a plurality of longitudinal grooves for holding and securing the reed in place without possible lateral movement. Other improvements in devices for abrading a reed will be apparent from the following disclosure.

DETAILED DISCLOSURE

Figure 4:
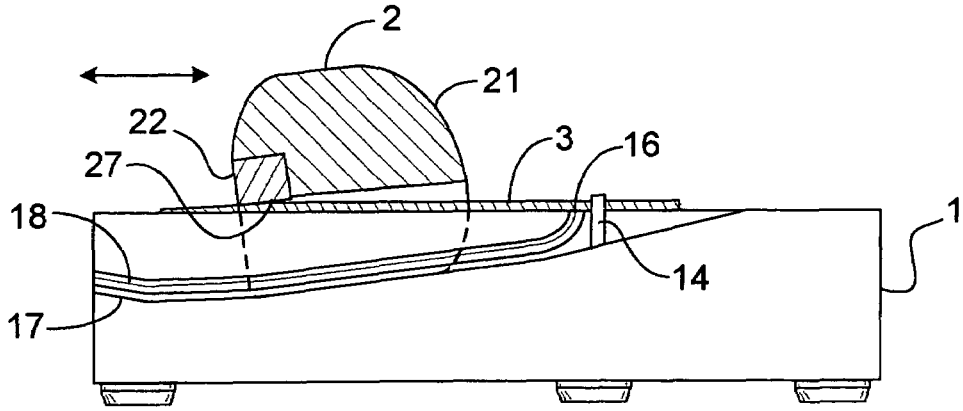
FIG. 4 is a sectional elevational view of the apparatus taken at right angle to the sectional view of FIG. 3 showing, in operation, the abrasion of the reed.

Referring now particularly to FIGS. 1, 2, 3, 4 and 5, the improved apparatus for abrading a reed has a base 1, preferably composed of polyethylene terephthalate. The base has an upper surface comprising two top surfaces 11, 11' separated by a central beam 15 and side edges 12, 12' with two tapered tracks 13, 13', on which carriage 2 slides to bring abrasive surface (file) 27 into contact with reed 3. The carriage 2 fits squarely on the tapered tracks 13, 13'. Accordingly, the reed 3 is placed on top surface 11 or 11' and it is abraded longitudinally as the carriage 2 is moved in the direction of the double arrow (FIG. 4). Each top surface 11, 11' is tapered slightly from a higher point at the outside edges of the base 1 toward the central beam 15 in base 1. Preferably, the transverse tilt of the top surfaces 11, 11' is such that, for every 1/16 inch from the outside edges toward the central beam there is a drop of about 0.001 inch.

Top surfaces 11, 11' of the base 1 have opposite side edge surfaces 12, 12' and, positioned in each of the side edge surfaces are substantially longitudinal channels 18, 18', one end of each such channel terminating in notches 16, 16' in the top surfaces of base 1. Adjacent, and positioned slightly behind, the notches 16, 16', are stopper pins 14, 14'. The carriage 2 is adapted to travel on the tracks 13, 13' and adapted to be positioned within the channels 18, 18'. Stopper pins 14, 14' are positioned in the vicinity of notches 16, 16', which aid in enabling carriage 2 to travel within the channels 18, 18' and also provide a guide for positioning the reed 3.

The tracks 13, 13' and the channels 18, 18' have inclines shaped so as to provide the required parabolic surface to the reed 3. The tracks 13, 13' in their regions of lesser slope will have, for example, an incline such that, at the guideline 19, 19', the incline is 0.006 inches and, at subsequent 3/16 inch intervals, the incline is 0.016 inch, 0.026 inch, 0.035 inch, 0.048 inch and 0.060 inch. The guideline 19 may, for example, be about 3/32 inch distant from the ends of top surfaces 11, 11'. Preferably, the lower ends of track 13, 13' are tapered slightly upward in end portions 17, 17'; this prevents the abrasive surface 27 from accidentally damaging the abraded reed.

The carriage 2 has two transversely spaced longitudinal legs 21, 21' supporting the carriage on the tracks 13, 13' of base 1. Positioned on the longitudinal legs 21, 21' are bearings 23, 23', disposed so that they travel within channels 18, 18' of base 1. (Bearing 23 is not visible in the drawings but it is located on longitudinal leg 21 in a position analogous to bearing 23' on longitudinal leg 21').

Figure 1:
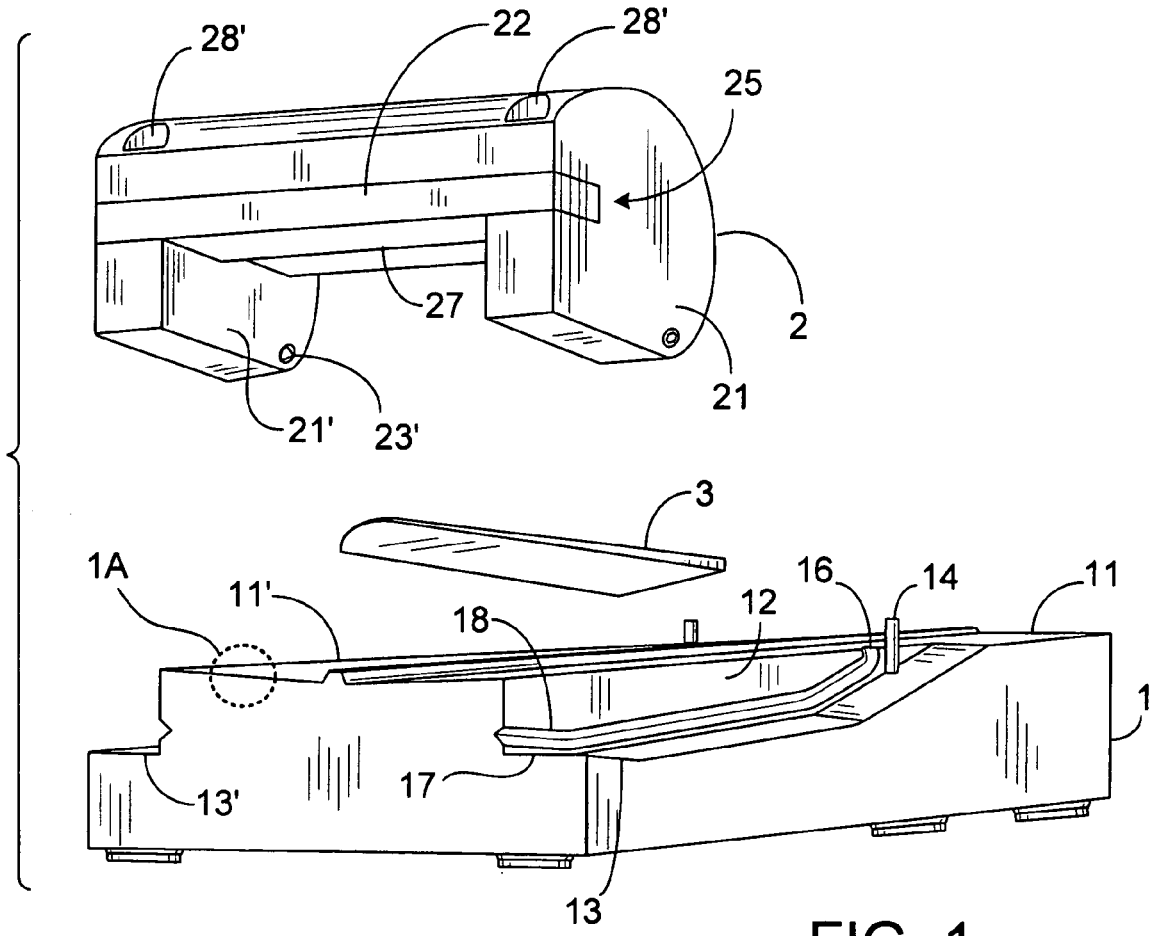
FIG. 1 is an exploded perspective view of an abrading apparatus constructed in accordance with the invention.
Figure 1A:
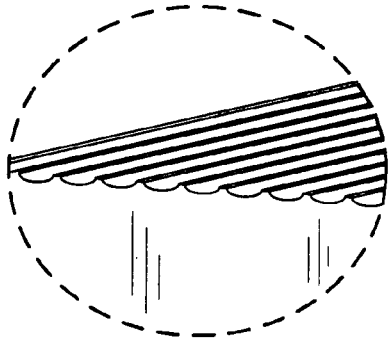
FIG. 1A is a magnified view of a portion of the surface shown in FIG. 1.
Figure 2:
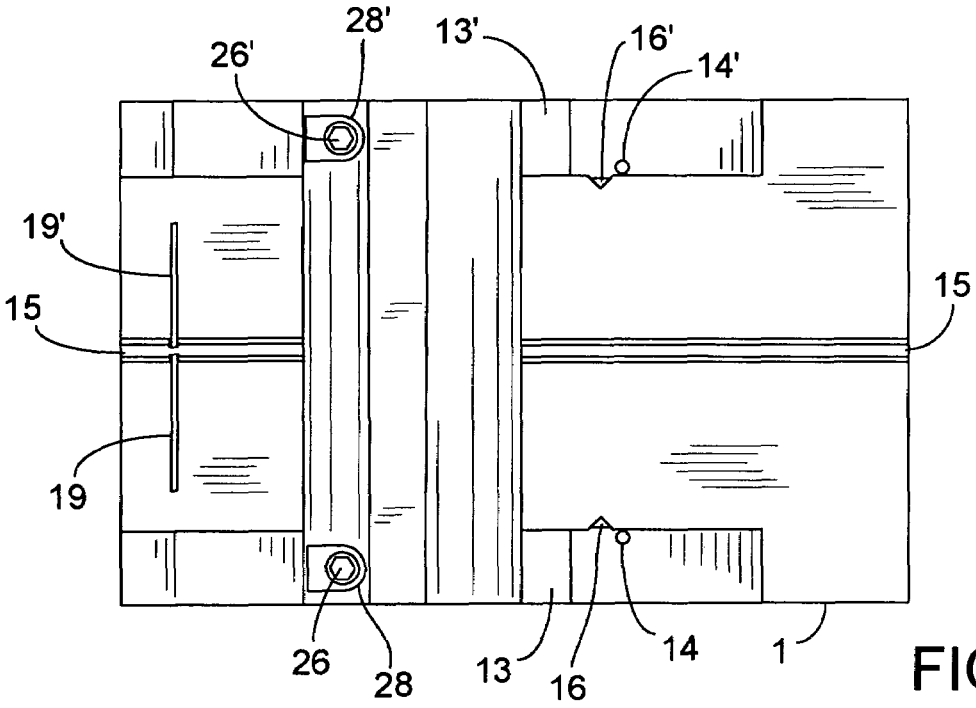
FIG. 2 is a top plan view of the apparatus of FIG. 1.
Figure 3:
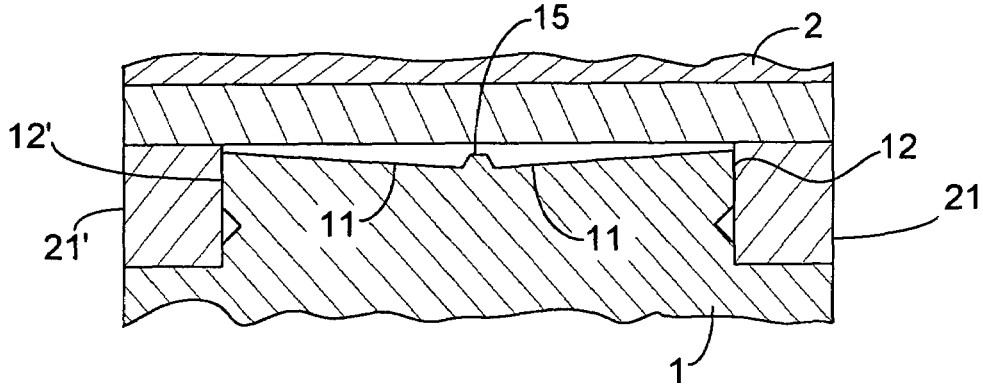
FIG. 3 is a sectional elevational view of the apparatus of FIG. 1.

A substantially flat abrasive surface 27, preferably composed of cobalt, is spaced from the top surfaces 11, 11' of the base 1 by an adjustable distance. As noted above, the top surfaces 11, 11' of the base 1 are tilted transversely toward each other from the side edge surfaces 12, 12' terminating in central beam 15. The tilt angle is preferably about 2°. The top surfaces 11, 11' of the base are longitudinally grooved as shown in FIG. 1A. The grooves are narrowly spaced so that, typically, there will be from 40 to 50 such grooves on each of top surfaces 11, 11', each top surface typically having a width of about ¾ inch. The tracks 13, 13' have regions of greater and lesser slope in order to raise the upper portion and the abrasive surface 27 by varying distances above the top surfaces 11, 11' of the base, thus imparting the necessary parabolic profile to the reed 3.

Figure 5:
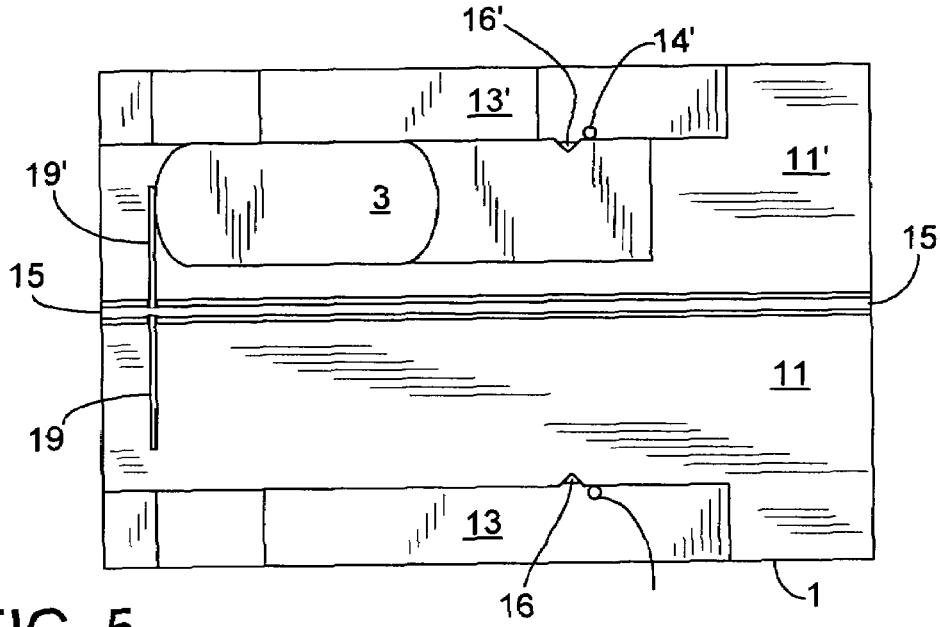
FIG. 5 is a top plan view of the base of FIG. 1 showing the reed positioned on the base, at guideline 19'.

Referring more particularly to FIG. 5, the top surfaces 11, 11' are equipped with stopper pins 14, 14' and guidelines 19, 19' for aid in positioning the reed. Typically, the guidelines 19, 19' will be about 3/32 inches distant from the end of top surfaces 11, 11'.

Figure 6:
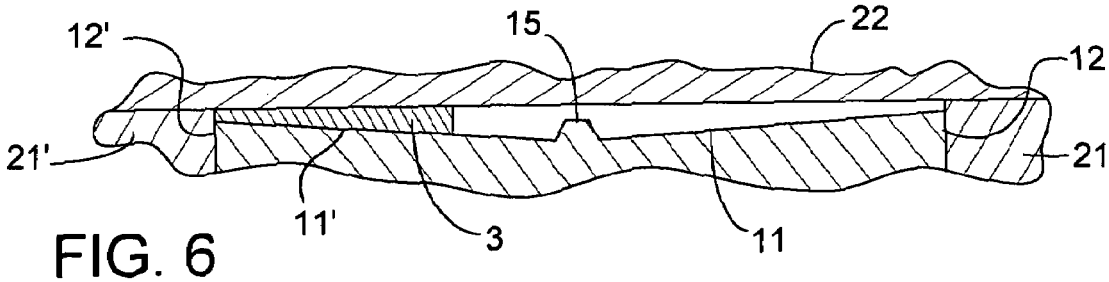
FIG. 6 is a fragmentary transverse sectional view of the FIG. 1 apparatus abrading a reed as positioned in FIG. 5.
Figure 7:
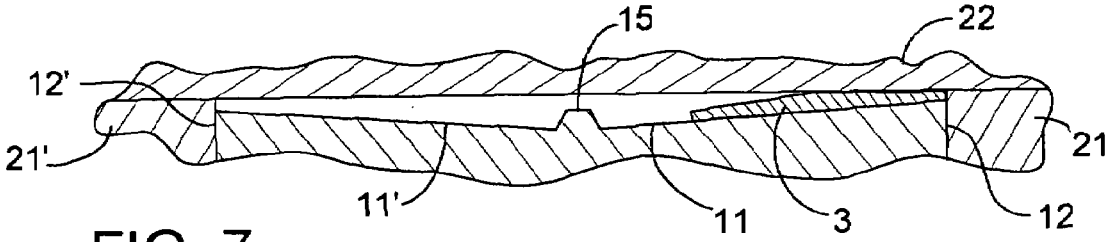
FIG. 7 is a fragmentary transverse sectional view of the FIG. 1 apparatus abrading the reed of FIG. 6 in which the reed is positioned at guideline 19, rather than guideline 19'.
Figure 8:
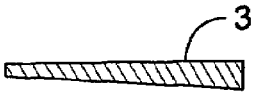
FIG. 8 is a transverse sectional view of the reed as abraded in FIG. . 6.
Figure 9:
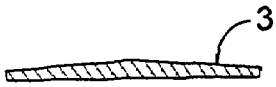
FIG. 9 is a transverse sectional view of the reed when abraded as in FIG. 6 and then in FIG. 7.
Figure 10:
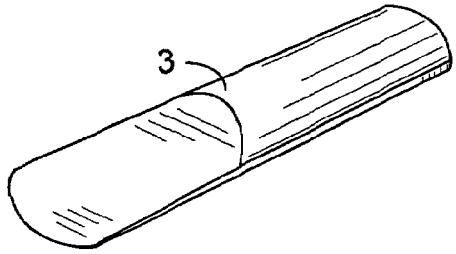
FIG. 10 is a perspective view of a reed after abrasion as shown in FIG. 6 and FIG. 7.

The reed 3 may be honed preferably by wetting it and by positioning the reed on top surface 11' as indicated in FIG. 5 with the corner tip of the reed touching the guideline 19' and the butt side of the reed touching stopper pin 14'. Carriage 2 is dropped into position in channels 18, 18' with the aid of stopper pins 14, 14' and notches 16, 16'. The operator slides carriage 2 back and forth to abrade one side of the reed as shown in FIG. 6. The reed is then removed and placed on the other grooved top surface 11, and abraded as shown in FIG. 7. Obviously, the reed may also be honed by placing it, in like manner, first on top surface 11.

To obtain a reed of different thickness, the reed may be displaced longitudinally on the grooved top surfaces 11, 11' so that the abrasive surface 27 makes contact with the reed at different portions of the reed.

If the musician desires to change the overall thickness of the reed, the positioning of the abrasive surface 27 within the carriage 2 can be adjusted. The carriage includes a transverse opening 25 in which the substantially flat member 22 bearing the abrasive surface 27 is disposed. A slight adjustment in the positioning of the substantially flat member 22 , of the order of about 0.005 inches, is possible by means of screws 26, 26' extending through a top section of the carriage 2 via indentations 28, 28'. By appropriate tightening of the screws, the positioning of the abrasive surface 27 can be controlled to yield single reeds with a thickness of as little as 1/6 the thickness of a newspaper.

The individual musician may desire to have a reed of non-symmetrical cross-sectional shape at its tip to provide a desired sound. This may be accomplished as by placing the reed 3 for abrasion obliquely with respect to guidelines 19, 19'. The reed may then be abraded by moving carriage 2 back and forth in a manner similar to that explained in connection with FIG. 5.

While there has been described what is at present considered to be the preferred embodiment of this invention, it will be obvious to those skilled in the art that various changes and modifications may be made therein without departing from the invention and it is, therefore, aimed to cover all such changes and modifications as fall within the true spirit and scope of this invention.

I claim:

1. An apparatus for abrading a reed for a musical instrument, said apparatus comprising a base having two top surfaces, two opposite side edge surfaces, two spaced longitudinally tapered parallel tracks adjacent to said side edge surfaces and two stopper pins, each top surface being provided with longitudinally disposed grooves, being tilted transversely toward each other from said side edge surfaces, and being separated by a longitudinally disposed central beam, each side edge surface being provided with longitudinal channels extending therealong, one end of said channels terminating in notches in the top surfaces, the stopper pins being located in the parallel ramps adjacent the notches in the top surfaces and extending above said surfaces, and a carriage slidable on the tracks, said carriage having two transversely spaced longitudinal legs for supporting the carriage on the tracks, a substantially flat member carrying an abrasive surface adapted to be positioned adjacent and spaced from the top surface of the base and two bearings extending from the inner surfaces of the legs and adapted to fit in the longitudinal channels.

2. An apparatus according to claim 1 in which the parallel tracks are tilted from the location of the stopper pins in a generally downward direction and terminate in an upwardly tilted region.

3. An apparatus according to claim 1 in which each tapered portion of each top surface is provided with one or more transverse guidelines perpendicular to the grooves.

4. The apparatus according to claim 1 in which the tilt of the transversely top surfaces is such that the level of each top surface drops about 0.001 inch for every 1/16 inch as measured from the side edge surface.

5. The apparatus according to claim 1 in which the carriage includes a transverse opening in which the substantially flat abrasive-carrying member is positioned.

6. The apparatus according to claim 5 which has means for adjusting the abrasive-carrying member.

7. The apparatus according to claim 6 which comprises screws extending through a top section of the carriage to contact a top surface of the abrasive-carrying member.

8. An apparatus according to claim 6 in which the abrasive-carrying member is spaced from the top surface of the base by an adjustable distance varying over a range of from about 0.006 to 0.060 inches.

9. The apparatus according to claim 5 in which the abrasive surface is composed of cobalt.

10. The apparatus according to claim 1 in which the base is composed of polyethylene terephthalate.

* * * * *